US006427925B1

(12) United States Patent
Gaudet

(10) Patent No.: US 6,427,925 B1
(45) Date of Patent: Aug. 6, 2002

(54) PREFABRICATED RAILWAY TRACK SYSTEM

(75) Inventor: Richard Christopher Gaudet, Sulphur, LA (US)

(73) Assignee: Century Precast, L.L.C., Sulphur, LA (US)

( * ) Notice: Subject to any disclaimer, the term of this patent is extended or adjusted under 35 U.S.C. 154(b) by 0 days.

(21) Appl. No.: 09/638,936

(22) Filed: Aug. 15, 2000

(51) Int. Cl.[7] ..... E01C 9/04

(52) U.S. Cl. ..... 238/8; 238/2; 238/6; 238/7; 238/9

(58) Field of Search ..... 238/2, 3, 4, 5, 238/6, 7, 8, 9, 129

(56) References Cited

U.S. PATENT DOCUMENTS 1,672,752 A * 6/1928 Coppock
3,863,840 A * 2/1975 Szarka et al.
4,236,670 A * 12/1980 Limmergard et al.
4,415,120 A * 11/1983 Thim
5,535,947 A * 7/1996 Hogue et al. ..... 238/2
5,535,948 A * 7/1996 Williams
5,577,662 A * 11/1996 Hogue et al.
5,609,294 A * 3/1997 Lucas, Jr.
5,655,711 A * 8/1997 Hull et al.
5,850,970 A * 12/1998 Hull et al.
5,899,379 A * 5/1999 Bruyn et al. ..... 238/8
6,016,968 A * 1/2000 Brookhart, Jr. et al.
6,079,630 A * 6/2000 Schroeder ..... 238/2
6,129,288 A * 10/2000 Petersen et al. ..... 238/2

OTHER PUBLICATIONS

Koehler, Michael, "South Sioux industry takes bumps out of rails," Mar. 12, 2000.
CXT Concrete Railroad Products brochure (no date).
Omega Industries Concrete Grade Crossings Advertisement (no date).

* cited by examiner

*Primary Examiner*—S. Joseph Morano
*Assistant Examiner*—Frantz F. Jules
(74) *Attorney, Agent, or Firm*—Alvin R. Wirthlin; Akin, Gump, Strauss, Hauer & Feld, L.L.P.

(57) ABSTRACT

A system for embedding a pair of rails of a railway track comprises a pair of field panels adapted for positioning opposite each other at outer sides of the rails and a gauge panel adapted for positioning between the rails. Each field panel has a side surface adapted to face its corresponding rail outer side and the gauge panel has opposite side surfaces adapted to face the inner sides of the rails. A first filler strip is associated with each of the field panels and a pair of second filler strips are associated with the gauge panel. Each of the first and second filler strips include a sealing portion that is adapted to contact one of the inner and outer rail sides and a mounting portion for connecting the filler strip to its respective panel. A U-shaped reinforcing member extends along a length of each filler strip mounting portion such that each filler strip is sandwiched between its respective reinforcing member and panel side surface. A plurality of fasteners extend from the side surface of each panel, through its respective filler strip and reinforcing member to thereby connect the filler strip to the panel. The reinforcing member provides structural rigidity to the filler strip.

22 Claims, 5 Drawing Sheets

PREFABRICATED RAILWAY TRACK SYSTEM

BACKGROUND OF THE INVENTION

1. Field of the Invention

This invention relates to railway crossing construction, and more particularly to prefabricated railway panel assemblies for installation at railway crossings.

2. Description of the Related Art

Railway tracks typically include a pair of steel rails supported on a plurality of traversely extending ties which in turn are supported on ballast material. At intersections with roadways, sidewalks and the like, the railway tracks are typically embedded so that the top surface of the rails are substantially the same height as the finish grade of the surrounding surface so that vehicles, pedestrians and the like may cross over the rails with minimal difficulty.

One typical way of embedding the rails includes installing gauge panels between the rails and field panels at opposite or outer sides of the rails such that a gap is formed between the rails and panels. Gaps must exist in order permit the flanged wheels of a train, car or other rail-guided vehicle to pass along the rails through the intersection without obstruction. These gaps also prevent the surrounding surface from contacting the rails, due to construction tolerances or surface shifting. However, the gaps between a rail and panels cause several problems. By way of example, foreign objects may become wedged in the gaps and present an obstacle for vehicles traveling along the rails, as well as for vehicles crossing the rails. Foreign objects and fluids may also fall through the gaps and accumulate between the rail and the surrounding surface. These fluids or foreign objects can damage the railway crossing system, such as the ballast, ties, attaching hardware, and so on. In order to address these problems, filler strips have been separately inserted into the gaps between the rails and panels, a time-consuming and labor-intensive task.

It has been proposed to bolt a filler strip directly to the panel at spaced locations, as shown for example in U.S. Pat. No. 4,415,120 issued to Thim. However, the filler strip may become wavy between mounting bolts and break the seal between the panel and rail, thus permitting liquid, dirt, and other debris to pass between the rail and panel.

SUMMARY OF THE INVENTION

According to the invention, a panel assembly is provided for installation at a railroad crossing. The panel assembly comprises a panel having a side surface adapted to face at least one of the rails. A filler strip has a sealing portion adapted to contact at least one rail and a mounting portion for connecting the filler strip to the panel. A reinforcing member extends along a length of the filler strip mounting portion such that the filler strip mounting portion is sandwiched between the reinforcing member and the panel side surface. A plurality of fasteners extend from the panel side surface through the filler strip and reinforcing member to thereby connect the filler strip to the panel. The reinforcing member provides structural rigidity to the filler strip.

Further according to the invention, a system for embedding a railway track having a pair of rails comprises a pair of field panels adapted for positioning opposite each other at outer sides of the rails and a gauge panel adapted for positioning between the rails. Each field panel has a side surface adapted to face its corresponding rail outer side and the gauge panel has opposite side surfaces adapted to face the inner sides of the rails. A first filler strip is associated with each of the field panels and a pair of second filler strips are associated with the gauge panel. Each of the first and second filler strips include a sealing portion that is adapted to contact one of the inner and outer rail sides and a mounting portion for connecting the filler strip to its respective panel. A reinforcing member extends along a length of each filler strip mounting portion such that each filler strip is sandwiched between its respective reinforcing member and panel side surface. A plurality of fasteners extend from the side surface of each panel, through its respective filler strip and reinforcing member to thereby connect the filler strip to the panel. The reinforcing member provides structural rigidity to the filler strip.

Other objects and advantages of the invention will become apparent upon reading the following detailed description and appended claims, and upon reference to the accompanying drawings.

BRIEF DESCRIPTION OF THE DRAWINGS

The preferred embodiments of the present invention will hereinafter be described in conjunction with the appended drawings, wherein like designations denote like elements, and wherein.

It is noted that the drawings are intended to depict only typical embodiments of the invention and therefore should not be considered as limiting the scope thereof.

DETAILED DESCRIPTION OF THE PREFERRED EMBODIMENTS

Figure 1:
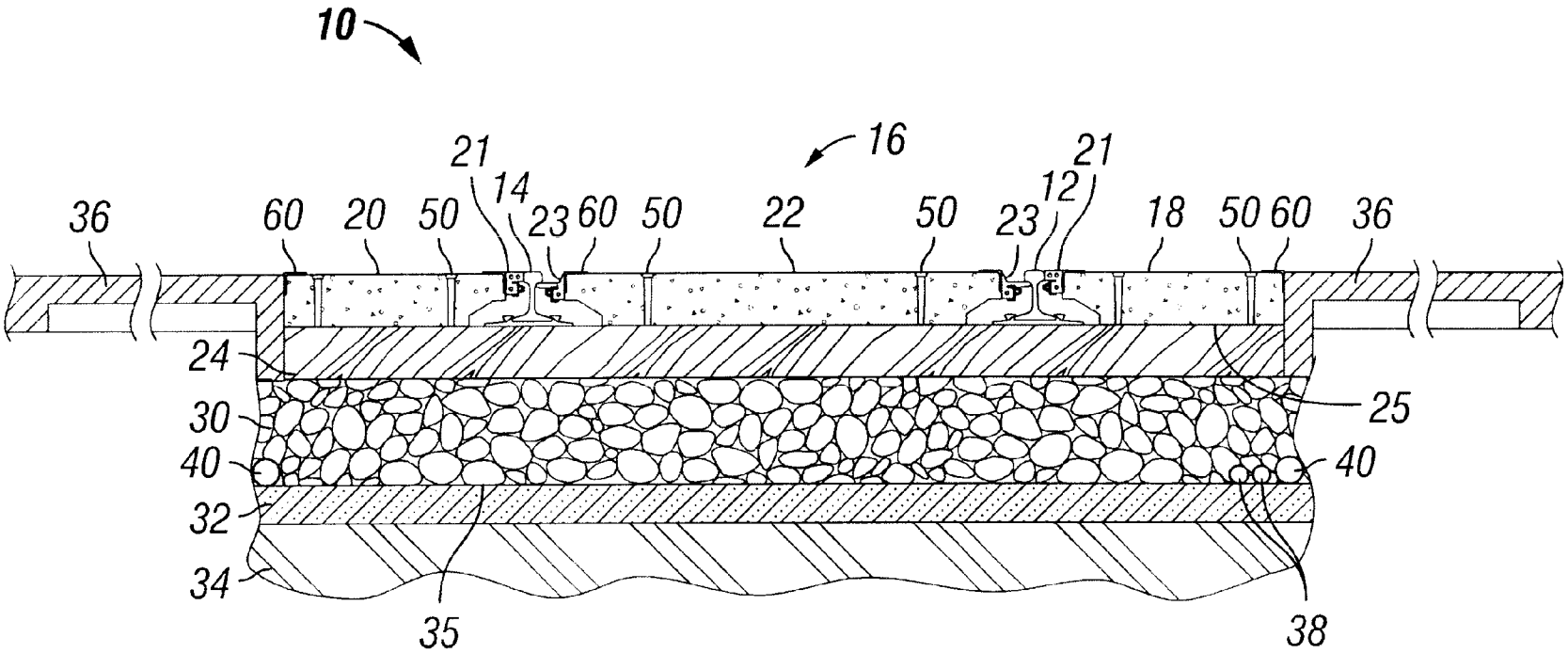
FIG. 1 is a cross sectional elevational view of a railroad crossing incorporating the panel system of the present invention.
Figure 2:
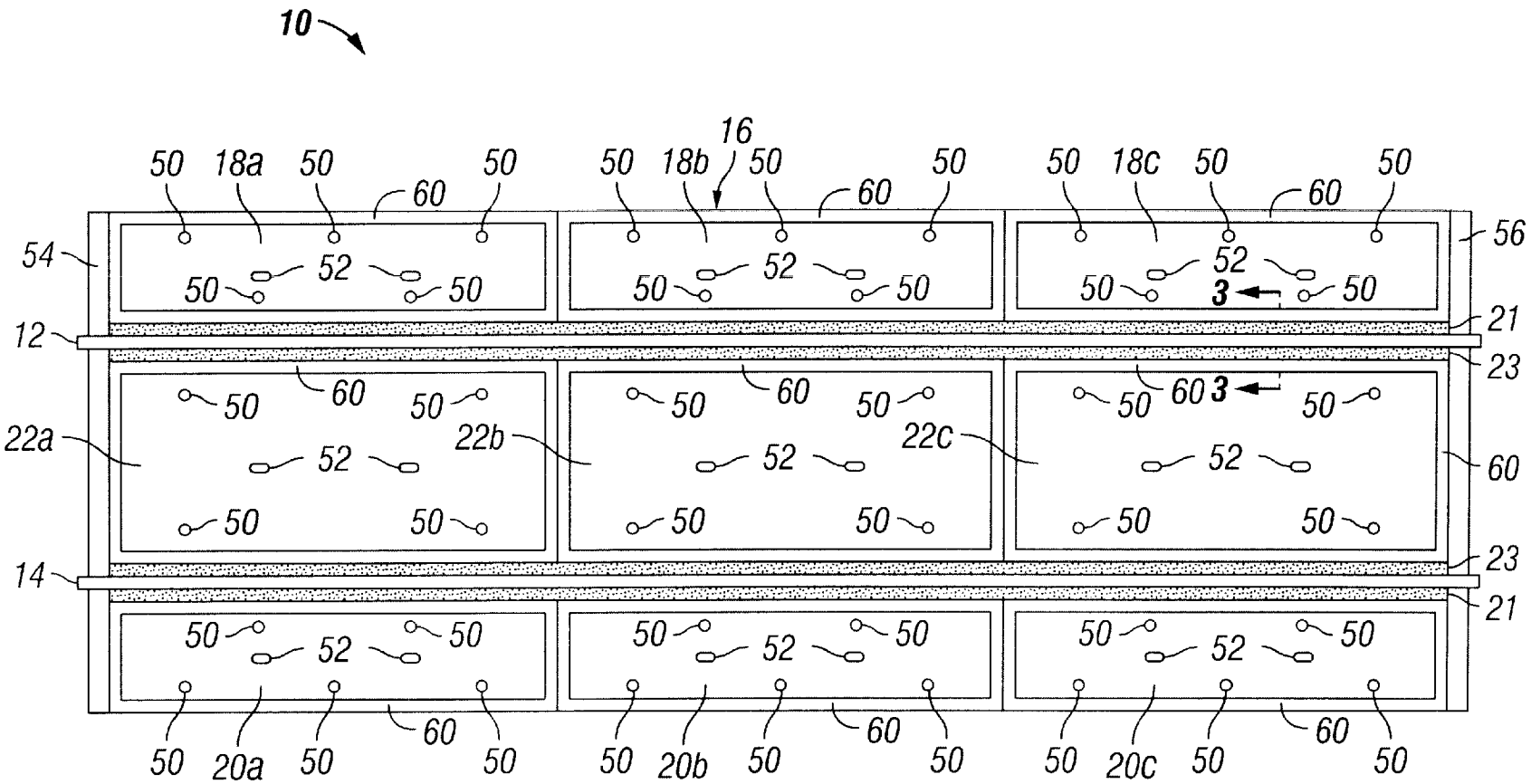
FIG. 2 is a top plan view of the railroad crossing and panel system of FIG. 1.

Referring now to the drawings, and to FIGS. 1 and 2 in particular, a railroad crossing 10 includes a pair of spaced rails 12 and 14 and a panel system 16 adapted to sealingly engage either side of the rails. The panel system 16 has a pair of field panels 18 and 20 that are positioned adjacent an outer side of the rails 12 and 14, respectively, and a gauge panel 22 that is positioned between the rails. Filler strips 21 are connected to a rail side of the field panels 18 and 20, while filler strips 23 are connected to opposite rail sides of the gauge panel 22 to sealingly engage the rails, as will be described in greater detail below. The panels 18, 20 and 22 may be constructed of concrete or other durable material with high compressive strength. Although not shown, rebar may be embedded in the panel material for increased strength. The filler strips 21 and 23 are preferably extrusion formed of rubber or other suitable elastomer or plastic material.

The rails 12, 14 are typically supported on ties 24 constructed of wood, concrete, or the like. Tie plates 26 (FIG. 3) may be provided between the ties 24 and the rails 12, 14. Spikes 28 may be driven into the ties to secure the rails and tie plates to the ties in a well-known manner. The ties 24 may be supported on a ballast layer 30, which is in turn supported on a compacted suballast layer 32 of hot or cold mix asphalt, which is in turn supported on a compacted subgrade layer 34. A non-woven geotextile fabric may be located between the ballast and suballast layers. Pipes or conduits 38 may be located in the ballast layer 30 and extend generally parallel to the rails 12, 14 for accommodating signal wires or the like. Perforated drainage pipes 40 may also be located in the ballast layer 30. A road surface 36 is located on either side of the panel system 16 and may be sloped or otherwise arranged to provide a relatively smooth transition between the railroad crossing 10 and the road surface 36.

As illustrated in FIG. 2, depending on the width of the railroad crossing and length of each panel 18, 20 and 22, a plurality of panels such as left end panels 18A, 20A and 22A, middle panels 18B, 20B and 22B, and right end panels 18C, 20C and 22C may be arranged to extend along the entire width of the railroad crossing. The panels 18, 20 and 22 are also positioned on the ties 24. A plurality of bores 50 are formed in each panel 18, 20, and 22. The bores 50 extend through the thickness of each panel and are each sized to receive a fastener (not shown) to secure the panels to the ties 24. Where the panels are not directly connected to the ties, the bores may be eliminated. An elastomeric layer 25 may be positioned between the panels and the ties. A pair of spaced slots or openings 52 are also formed in each panel for temporary connection to a lifting device (not shown) during installation of the panels at the railroad crossing 10. As shown, a chamfer 54 may be formed at the left terminal edge of the left end panels 18A, 20A and 22A, and a chamfer 56 may be formed at the right terminal edge of the right end panels 18C, 20C and 22C. The chamfers 54, 56 extend generally transverse to the rails 12, 14. A frame 60 surrounds an upper perimeter of each panel and is embedded into the panel material.

Figure 3:
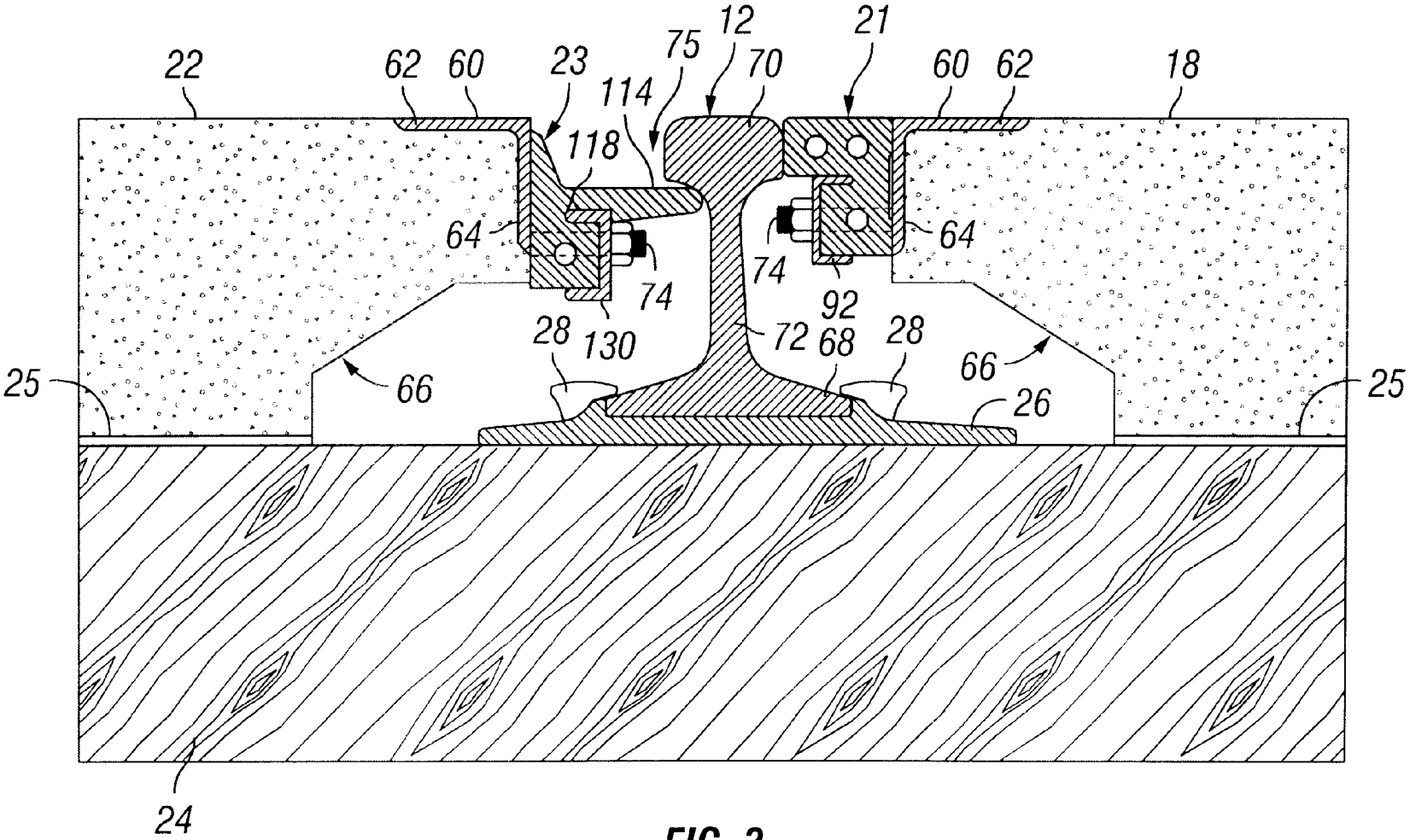
FIG. 3 is a cross sectional elevational view of a portion of the panel system taken along line 3—3 of FIG. 2.
Figure 4:
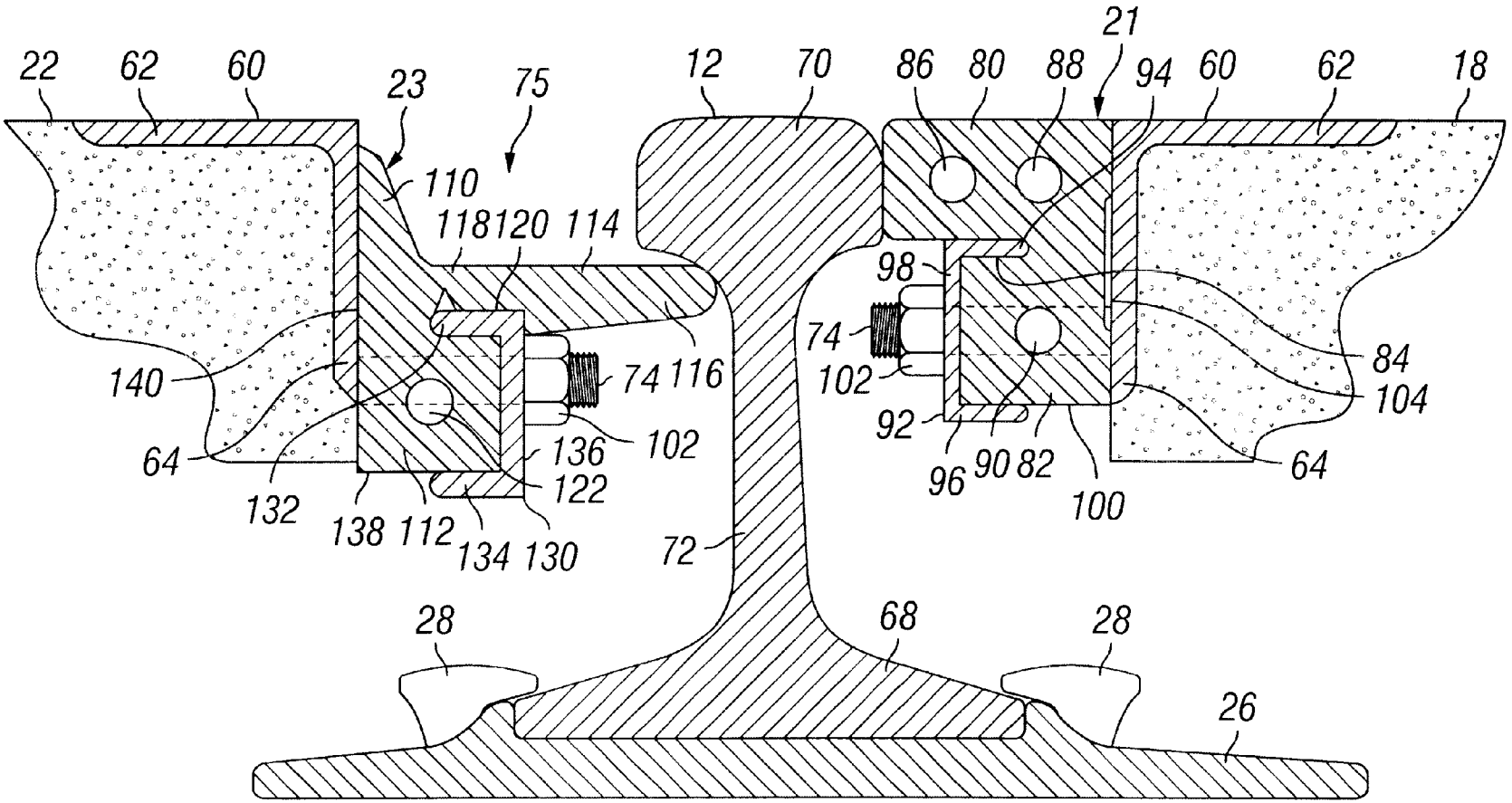
FIG. 4 is an enlarged cross sectional view of the panel system of FIG. 3.

With reference now to FIGS. 3 and 4, the frame 60 is L-shaped in cross section and includes a substantially horizontal leg 62 that extends from a substantially vertical leg 64. The frame 60 is preferably embedded in the panel during panel formation and serves in part to protect the edges of the panel from wear and chipping.

The rails 12 and 14 are of well-known construction and include a base flange 68 connected to a rail head 70 through a web 72. The elongate side of the panels adjacent he rails are recessed, as shown by numeral 66, in order to provide clearance for the base flange 68, tie plates 26 and spikes 28. A row of fasteners 74, preferably in the form of threaded studs, extend away from the vertical leg 64 of each panel toward the web 72 for mounting the filler strips 21 and 23 to their respective panels. The studs are preferably fixedly connected to the vertical leg 64 through welding, but may alternatively be embedded in the panel material during formation of the panel.

The filler strip 21 includes a sealing portion 80 connected to a mounting portion 82. Preferably, the sealing portion 80 and mounting portion 82 are integrally formed during an extrusion process. The sealing portion 80 extends between and abuts against the leg 64 of the frame 60 and the head 70 of the rail 12 when the filler strip 21 is mounted on the field panel 18. A groove 84 is formed in the filler strip 21 and extends along the length thereof between the sealing portion 80 and mounting portion 82. Bores 86 and 88 are formed in the sealing portion 80 and a bore 90 is formed in the mounting portion 82 to reduce the amount of material and thus reduce the cost of the filler strip 21, as well as to provide some flexibility during compression of the filler strip to assure a tight seal. Rebar or the like (not shown) may be located in one or more of the bores to provide additional reinforcement to the filler strip 21 and connect adjacent panels together.

An elongate reinforcing member 92 is mounted to the field panels 18, 20. The reinforcing member 92 supports the filler strip 21 during installation of the field panels 18, 20 and resists outside forces during use during use that may be caused by vehicles and foreign objects. The reinforcing member 92 may be constructed of metal such as steel or aluminum, fiberglass or other composites, plastic, or any other suitable material. The reinforcing member 92 preferably extends along the entire length of the filler strip 21. The reinforcing member 92 is preferably U-shaped in cross-section with an upper leg 94, a lower leg 96 and a plate 98 extending between the legs. The lower leg 96 is positioned against the lower surface 100 of the filler strip 21, while the upper leg 94 is located in the groove 84. The plate 98 includes a plurality of openings (not shown) coincident with the studs 74 so that a threaded portion of each stud extends outwardly of the plate. A nut 102 is threaded onto each stud 74 to compress the mounting portion 82 between the reinforcing member 92 and the vertical leg 64 and secure both the reinforcing member 92 and the filler strip 21 to the field panel 18, 20. In an alternative embodiment, the reinforcing member 92 may be L-shaped with the plate 98 serving as a mounting plate and one of the legs 94, 96 serving as a ledge for supporting the filler strip 21. A channel 104 may be formed along the length of the filler strip 21 to allow additional compression of the filler strip and assure a tight seal between the rail head 70 and field panel 18, 20. With this arrangement, the reinforcing member keeps the filler strip 21 straight and level with the top of the field panel and prevents the filler strip from being forced down when under pressure from vehicle traffic and foreign objects. The reinforcing member 92 also prevents the filler strip 21 from deforming upwards during installation of the field panel and throughout the service life of the filler strip 21. This is a great advantage over prior art systems where the filler strips have been known to migrate upward when in service. The interlocking nature between the reinforcing member 92 and the filler strip 21 prevents upward movement of the filler strip 21.

Each filler strip 23 includes a sealing portion 110 connected to a mounting portion 112. Preferably, the sealing portion 110 and mounting portion 112 are integrally formed during an extrusion process. A sealing finger 114 is pivotally connected to the main body of the sealing portion 110 at an integrally formed hinge joint 118. An outer free end 116 of the finger 114 abuts against the head 70 and/or the web 72 of the rail 12 when the filler strip 23 is mounted on the gauge panel 22. The position of the finger 114 under the rail head 70 forms a channel 75 that receives the wheel flange of a rail-guided vehicle. A groove 120 is formed in the filler strip 23 and extends along the length thereof between the sealing portion 110 and mounting portion 112. A bore 122 is formed in the mounting portion 112 to reduce the amount of material and thus reduce the cost of the filler strip 23, as well as to provide some flexibility during compression of the filler strip to assure a tight seal. Rebar or the like (not shown) may be located in the bore 122 to provide additional reinforcement to the filler strip 23 and to connect adjacent panels together.

An elongate reinforcing member 130 is mounted to the gauge panel 22. The reinforcing member 130 provides support for the filler strip 23 during installation of the gauge panel 22 and resists outside forces during use that may be caused by vehicles and foreign objects. The reinforcing member 130 is similar in construction to the reinforcing member 92 and preferably extends along the entire length of the filler strip 23, with an upper leg 132, a lower leg 134 and a plate 136 extending between the legs. The lower leg 134 is positioned against the lower surface 138 of the filler strip 23, while the upper leg 132 is located in the groove 120. The plate 136 includes a plurality of openings (not shown) coincident with the studs 74 so that a threaded portion of each stud extends outwardly of the plate. A nut 102 is threaded onto each stud 74 to compress the mounting portion 112 between the reinforcing member 130 and the vertical leg 64 and secure both the reinforcing member 130 and the filler strip 23 to the gauge panel 23. In an alternative embodiment, the reinforcing member 130 may be L-shaped with the plate 136 serving as a mounting plate and one of the legs 132, 134 serving as a ledge for supporting the filler strip 23. A rear surface 140 of the filler strip 23 preferably extends at an obtuse angle with respect to the lower surface 138 before the filler strip 23 is mounted on the panel 22 so that a tight seal is formed between the filler strip 23 and the vertical leg 64 after mounting. With this arrangement, the reinforcing member 130 keeps the filler strip 23 straight and prevents the filler strip from being forced down when under pressure from vehicle traffic and foreign objects. The reinforcing member 130 also prevents the mounting portion 112 of the filler strip 23 from deforming upwards during installation of the gauge panel and throughout the service life of the filler strip 21. This is a great advantage over prior art systems where the filler strips have been known to migrate upward when in service. The interlocking nature of the reinforcing member 130 and the filler strip 23 prevents upward movement of the filler strip 23.

Figure 5:
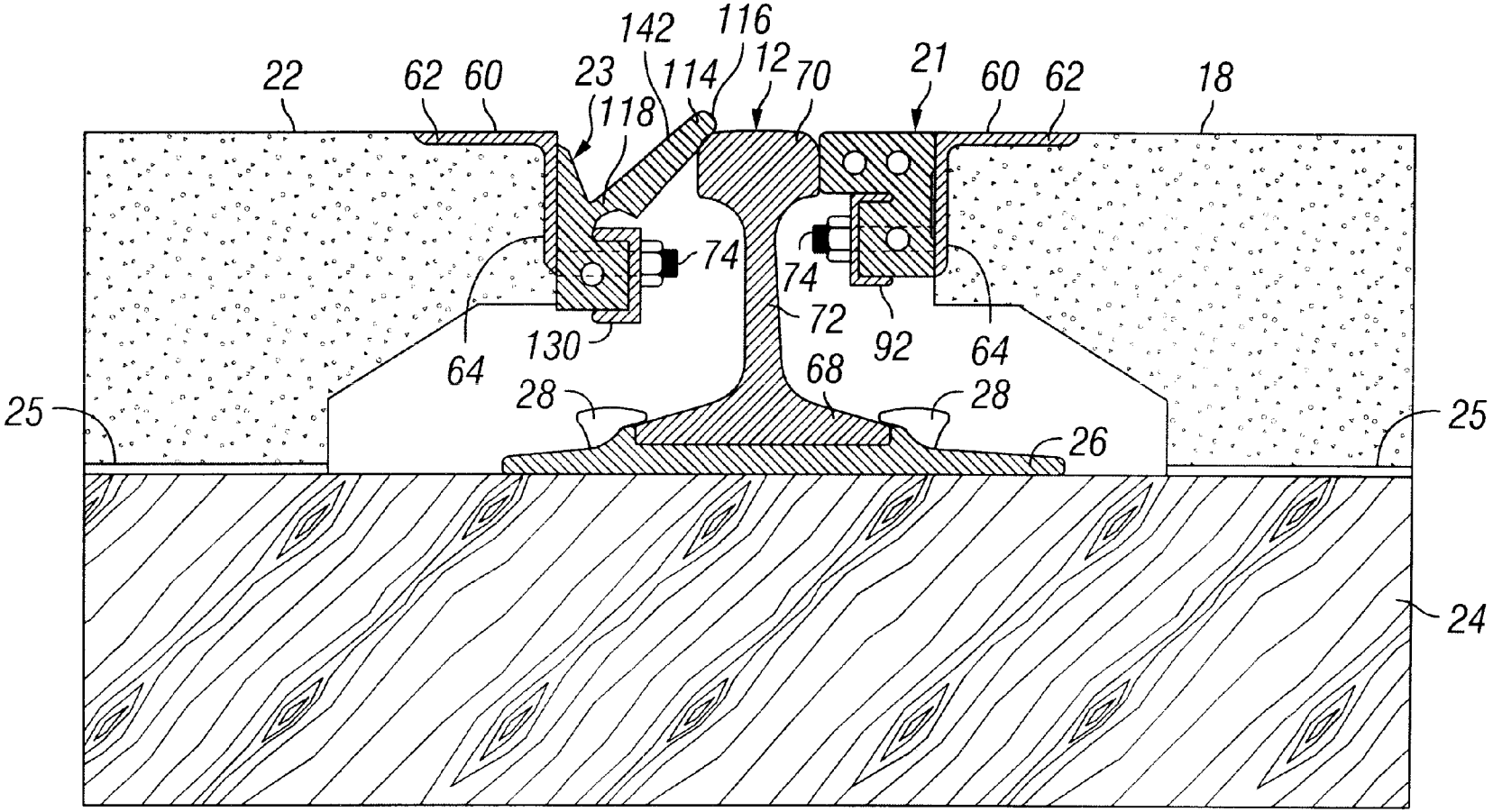
FIG. 5 is a view similar to FIG. 3 illustrating installation of a gauge panel system.

When the gauge panel 22 is first set in place between the rails 12 and 14, and as shown in FIG. 5, the finger 114 of each filler strip 23 will initially rest on the upper surface of the rail head 70. This feature is especially advantageous since the gauge panel can be lowered in a linear direction between the rails positioned more easily than the prior art method of canting the gauge panel during positioning. The fingers 114 are then pressed downwardly in a direction represented by arrow 142 by a tool (not shown) to slip the fingers 114 to a position under the rail head as shown in FIG. 3. Once in position, the fingers 114 sealingly engage the rails and the reinforcing members 130 prevent the fingers from being forced further down during use.

It is to be understood that the terms left, right, middle, horizontal, vertical and their respective derivatives, as may be used throughout the specification, refer to relative, rather than absolute, positions and/or orientations.

While the invention has been taught with specific reference to the above-described embodiments, those skilled in the art will recognize that changes can be made in form and detail without departing from the spirit and the scope of the invention. Thus, the described embodiments are to be considered in all respects only as illustrative and not restrictive. The scope of the invention is, therefore, indicated by the appended claims rather than by the foregoing description. All changes that come within the meaning and range of equivalency of the claims are to be embraced within their scope.

What is claimed is:

1. A panel assembly for installation at a railroad crossing having a pair of rails, the panel assembly comprising:

a panel having a side surface adapted to face one of the rails;

a filler strip having a sealing portion adapted to contact the one rail and a mounting portion located below the sealing portion for connecting the filler strip to the panel;

a reinforcing member extending along a length of the filler strip mounting portion such that the filler strip mounting portion is sandwiched between the reinforcing member and the panel side surface; and a plurality of fasteners extending from the panel side surface through the filler strip mounting portion and reinforcing member to thereby connect the filler strip to the panel, the reinforcing member providing structural rigidity to the filler strip.

2. A panel assembly according to claim 1, wherein the filler strip mounting portion includes a side surface adapted to face the one rail, the reinforcing member including a plate that abuts the side surface of the filler strip mounting portion.

3. A panel assembly according to claim 2, wherein the filler strip mounting portion is compressed between the plate and the panel.

4. A panel assembly according to claim 3, and further comprising at least one bore extending lengthwise through the filler strip mounting portion for facilitating compression of the filler strip mounting portion.

5. A panel assembly according to claim 1, and further comprising a frame embedded in the panel adjacent the panel side surface, each fastener being mounted to the frame.

6. A panel assembly for installation at a railroad crossing having a pair of rails, the panel assembly comprising:

a panel having a side surface adapted to face one of the rails;

a filler strip having a sealing portion adapted to contact the one rail and a mounting portion for connecting the filler strip to the panel, wherein the filler strip mounting portion includes a side surface adapted to face the one rail and a lower surface;

a reinforcing member extending along a length of the filler strip mounting portion such that the filler strip mounting portion is sandwiched between the reinforcing member and the panel side surface, the reinforcing member including a lower leg that extends toward the panel side surface from the plate and abuts the lower surface of the mounting portion; and a plurality of fasteners extending from the panel side surface through the filler strip and the reinforcing member to thereby connect the filler strip to the panel, the reinforcing member providing structural rigidity to the filler strip.

7. A panel assembly according to claim 6, wherein an elongate groove is formed in the filler strip between the sealing and mounting portions, the reinforcing member including an upper leg that extends into the groove from the plate to thereby support the sealing portion.

8. A panel assembly according to claim 7, wherein each fastener comprises:

a stud having a first end connected to the panel and a second threaded end extending from the plate; and a nut threaded onto the stud for securing the plate and filler strip to the panel.

9. A panel assembly according to claim 8, wherein the filler strip mounting portion is compressed between the plate and the panel.

10. A panel assembly according to claim 8, and further comprising a frame embedded in the panel adjacent the panel side surface, the first end of each stud being mounted to the frame.

11. A panel assembly for installation at a railroad crossing having a pair of rails, the panel assembly comprising:

a panel having a side surface adapted to face one of the rails;

a filler strip having a sealing portion adapted to contact the one rail and a mounting portion for connecting the filler strip to the panel;

wherein the sealing portion of the filler strip includes a main body and a sealing finger pivotally connected to the main body at an integrally formed hinge joint, a distal end of the sealing finger being adapted to contact the one rail.

12. A system for embedding a railway track having a pair of rails, each rail including an inner side that faces the inner side of the other rail and an outer side, the system comprising:

a pair of field panels adapted for positioning opposite each other at the rail outer sides, each field panel having a side surface adapted to face its corresponding rail outer side;

a gauge panel adapted for positioning between the rails, the gauge panel having opposite side surfaces adapted to face the inner sides of the rails;

a first filler strip associated with each of the field panels and a pair of second filler strips associated with the gauge panel, each of the first and second filler strips including a sealing portion adapted to contact one of the inner and outer rail sides and a mounting portion located below the sealing portion for connecting the filler strip to its respective panel;

a reinforcing member extending along a length of each filler strip mounting portion such that each filler strip is sandwiched between its respective reinforcing member and panel side surface; and a plurality of fasteners extending from the side surface of each panel, through its respective filler strip and reinforcing member to thereby connect the filler strip to the panel, the reinforcing member providing structural rigidity to the filler strip.

13. A system according to claim 12, wherein each filler strip mounting portion includes a side surface adapted to face its respective rail, each reinforcing member including a plate that abuts the side surface of its respective mounting portion.

14. A system according to claim 13, wherein each filler strip mounting portion is compressed between its respective plate and panel.

15. A system according to claim 14, and further comprising at least one bore formed in each mounting portion for facilitating compression of each mounting portion.

16. A system according to claim 15, and further comprising a frame embedded in each panel side surface, the fasteners being mounted to the frames.

17. A system for embedding a railway track having a pair of rails, each rail including an inner side that faces the inner side of the other rail and an outer side, the system comprising:

a pair of field panels adapted for positioning opposite each other at the rail outer sides, each field panel having a side surface adapted to face its corresponding rail outer side;

a gauge panel adapted for positioning between the rails, the gauge panel having opposite side surfaces adapted to face the inner sides of the rails;

a first filler strip associated with each of the field panels and a pair of second filler strips associated with the gauge panel, each of the first and second filler strips including a sealing portion adapted to contact one of the inner and outer rail sides and a mounting portion for connecting the filler strip to its respective panel;

a reinforcing member extending along a length of each filler strip mounting portion such that each filler strip is sandwiched between its respective reinforcing member and panel side surface;

wherein each filler strip mounting portion includes a lower surface and a side surface adapted to face its respective rail, and each reinforcing member includes a plate that abuts the side surface of its respective mounting portion and a lower leg that extends from its respective plate toward its respective panel side surface and abuts the lower surface of the mounting portion.

18. A system according to claim 17, wherein an elongate groove is formed in each filler rip between the sealing and mounting portions, each reinforcing member including an upper leg that extends from the plate into the groove to thereby support the sealing portion.

19. A system according to claim 18 wherein each fastener comprises:

a stud having a first end connected to the panel and a second threaded end extending from its respective plate; and a nut threaded onto each stud for securing the reinforcing members and filler strips to their respective panels.

20. A system according to claim 19, wherein each filler strip mounting portion is compressed between its respective plate and panel.

21. A system according to claim 19, and further comprising a frame embedded in each panel side surface, the first end of each stud being mounted to the frame.

22. A system for embedding a railway track having a pair of rails, each rail including an inner side that faces the inner side of the other rail and an outer side, the system comprising:

a pair of field panels adapted for positioning opposite each other at the rail outer sides, each field panel having a side surface adapted to face its corresponding rail outer side;

a gauge panel adapted for positioning between the rails, the gauge panel having opposite side surfaces adapted to face the inner sides of the rails;

a first filler strip associated with each of the field panels and a pair of second filler strips associated with the gauge panel, each of the first and second filler strips including a sealing portion adapted to contact one of the inner and outer rail sides and a mounting portion for connecting the filler strip to its respective panel;

wherein the sealing portion of each second filler strip includes a main body and a sealing finger pivotally connected to the main body at an integrally formed hinge joint, a distal end of the sealing fingers being adapted to contact the inner sides of the rails.

* * * * *